US006293813B1

(12) United States Patent
Johnston et al.

(10) Patent No.: US 6,293,813 B1
(45) Date of Patent: Sep. 25, 2001

(54) ELECTRICAL CONNECTOR WITH LATCHING BACKPLATE ASSEMBLY

(75) Inventors: Andrew L. Johnston, Redwood City; David C. North, Santa Clara; Bruce R. Garrett, Newark, all of CA (US)

(73) Assignee: Silicon Graphics, Mountain View, CA (US)

( * ) Notice: Subject to any disclaimer, the term of this patent is extended or adjusted under 35 U.S.C. 154(b) by 0 days.

(21) Appl. No.: 09/608,935

(22) Filed: Jun. 30, 2000

(51) Int. Cl.[7] ..... H01R 13/62
(52) U.S. Cl. ..... 439/157; 439/680
(58) Field of Search ..... 439/157, 680, 439/677, 372, 310, 352, 160, 152, 358

(56) References Cited

U.S. PATENT DOCUMENTS 3,488,622 * 1/1970 Gley ..... 439/157
5,252,084 * 10/1993 Wakata ..... 439/157
5,320,544 * 6/1994 Naoto et al. ..... 439/157

* cited by examiner

*Primary Examiner*—Brian Sircus
*Assistant Examiner*—Javaid Nasri
(74) *Attorney, Agent, or Firm*—Baker Botts L.L.P.

(57) ABSTRACT

An electrical connector (10) includes a cable dock (12) having a first connector (16) and a backshell assembly (14) having a second connector (18). The second connector (18) is adapted for engagement with the first connector (16). The electrical connector (10) also includes a locking element (40) coupled to the cable dock (12) and a latch (46) coupled to the backshell assembly (14). The latch (46) is operable to engage the locking element (40) and, in response to movement of the latch (46) relative to the backshell assembly (14), engage the first connector (16) with the second connector (18).

28 Claims, 3 Drawing Sheets

ELECTRICAL CONNECTOR WITH LATCHING BACKPLATE ASSEMBLY

TECHNICAL FIELD OF THE INVENTION

This invention relates in general to the field of electrical connectors, and more particularly, to an electrical connector with latching backplate assembly.

BACKGROUND OF THE INVENTION

Computer systems and other types of electronic components and systems generally include input/output ports for providing communication links between electronic components. Electrical connector systems are widely employed to connect the various electronic components together when a relatively large number of electrical connections must be made at the same time. Electrical connector systems generally employ a cable dock coupled to the input/output port of an electronic component and a backshell assembly coupled to a communication medium. Either the cable dock or the backshell assembly generally includes an array of male contacts while the other includes a corresponding and matching array of mating female contacts. Each male contact extends into a corresponding female contact when the cable dock and backshell assembly are brought together, thereby establishing a desired pattern of electrical connections.

The backshell assembly is generally secured to the cable dock using a jackscrew coupling. For example, a plurality of jackscrews are coupled to the backshell assembly and each screws into a corresponding threaded receptacle on the cable dock. Threading the jackscrews into the threaded receptacles engages the corresponding electrical connection contacts and prevents disconnection of the backshell assembly from the cable dock.

Jackscrew-coupled electrical connector systems, however, suffer several disadvantages. For example, computer systems and other types of electronic equipment generally require a large quantity of communication connections. Thus, a correspondingly large number of jackscrews must be actuated to connect the backshell assemblies to corresponding cable docks. The jackscrews are generally small in diameter, thereby resulting in a great deal of difficulty in securing the large number of electrical connections. Additionally, over-tightening of the jackscrews during connection of the cable dock with the backshell assembly results in increased difficulty in disconnecting the cable dock from the backshell assembly.

SUMMARY OF THE INVENTION

Accordingly, a need has arisen for an improved electrical connector system and method that provides increased ease of connection and disconnection of electrical components. The present invention provides an electrical connector system and method that addresses shortcomings of prior electrical connector systems and methods.

According to one embodiment of the present invention, an electrical connector system includes a cable dock having a first connector and a backshell assembly having a second connector. The second connector is adapted for engagement with the first connector. The electrical connector system also includes a locking element coupled to the cable dock and a latch coupled to the backshell assembly. The latch is operable to engage the locking element and, in response to movement of the latch relative to the backshell assembly, engage the first connector with the second connector.

According to another embodiment of the present invention, a method for coupling an electrical connector assembly includes aligning a first connector coupled to a cable dock with a second connector coupled to a backshell assembly. The first connector is adapted for engagement with the second connector. The method also includes receiving a locking element coupled to the cable dock in a latch. The latch is coupled to the backshell assembly. The method further includes engaging the first connector with the second connector by actuating the latch relative to the backshell assembly.

The invention provides several technical advantages. For example, in one embodiment of the invention, a latch coupled to the backshell assembly engages a locking element coupled to the cable dock. Actuation of the latch relative to the backshell assembly causes linear movement of the backshell assembly into engagement with the cable dock. The latch may also comprise a feedback feature to provide an operator of the electrical connector system with an indication that the latch is fully engaged or fully disengaged.

Other technical advantages will be readily apparent to one skilled in the art from the following figures, descriptions, and claims.

BRIEF DESCRIPTION OF THE DRAWINGS

For a more complete understanding of the present invention and the advantages thereof, reference is now made to the following descriptions taken in connection with the accompanying drawings, in which.

DETAILED DESCRIPTION OF THE INVENTION

Figure 1:
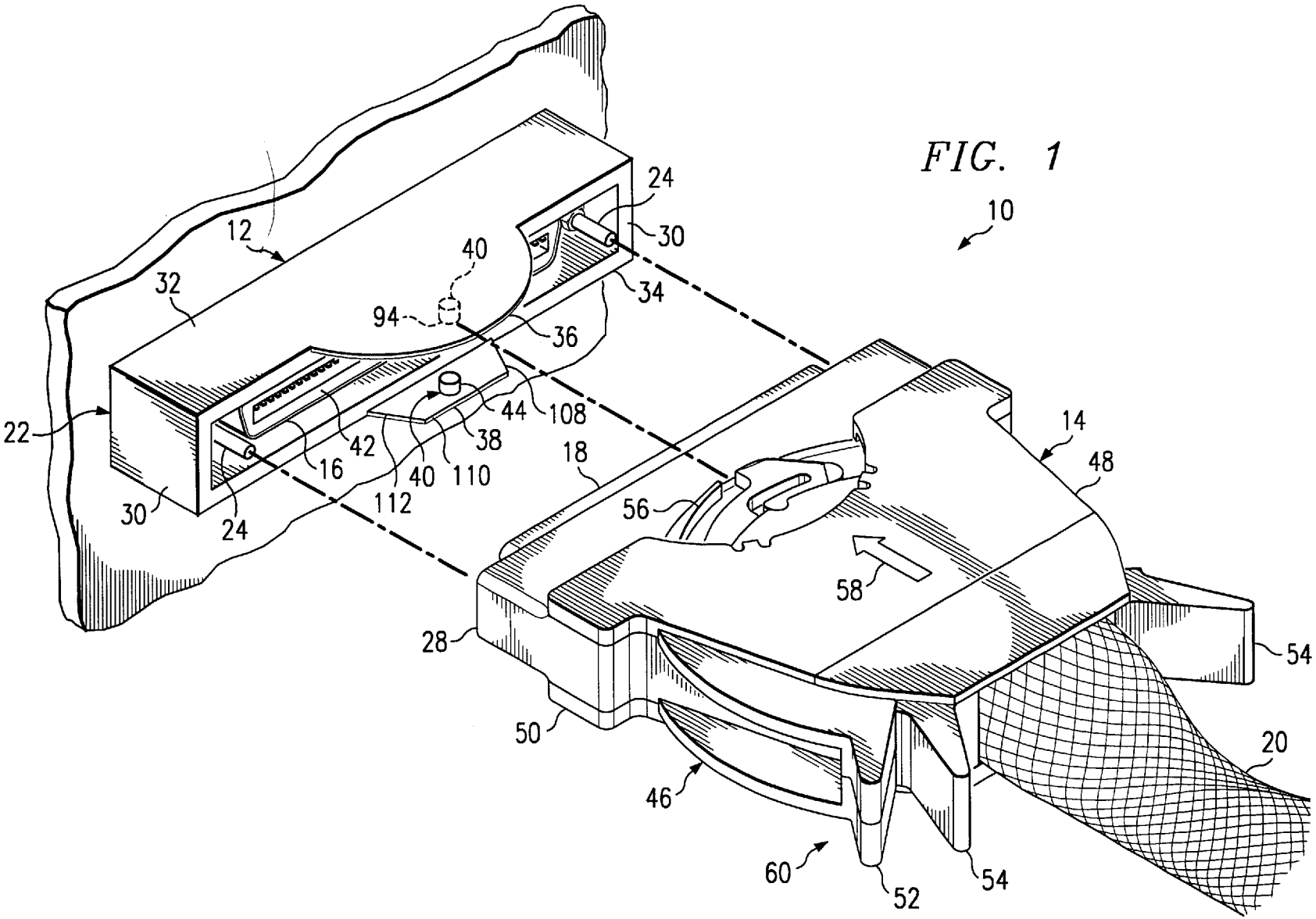
FIG. 1 is a diagram illustrating an electrical connector system in accordance with an embodiment of the present invention.
Figure 2:
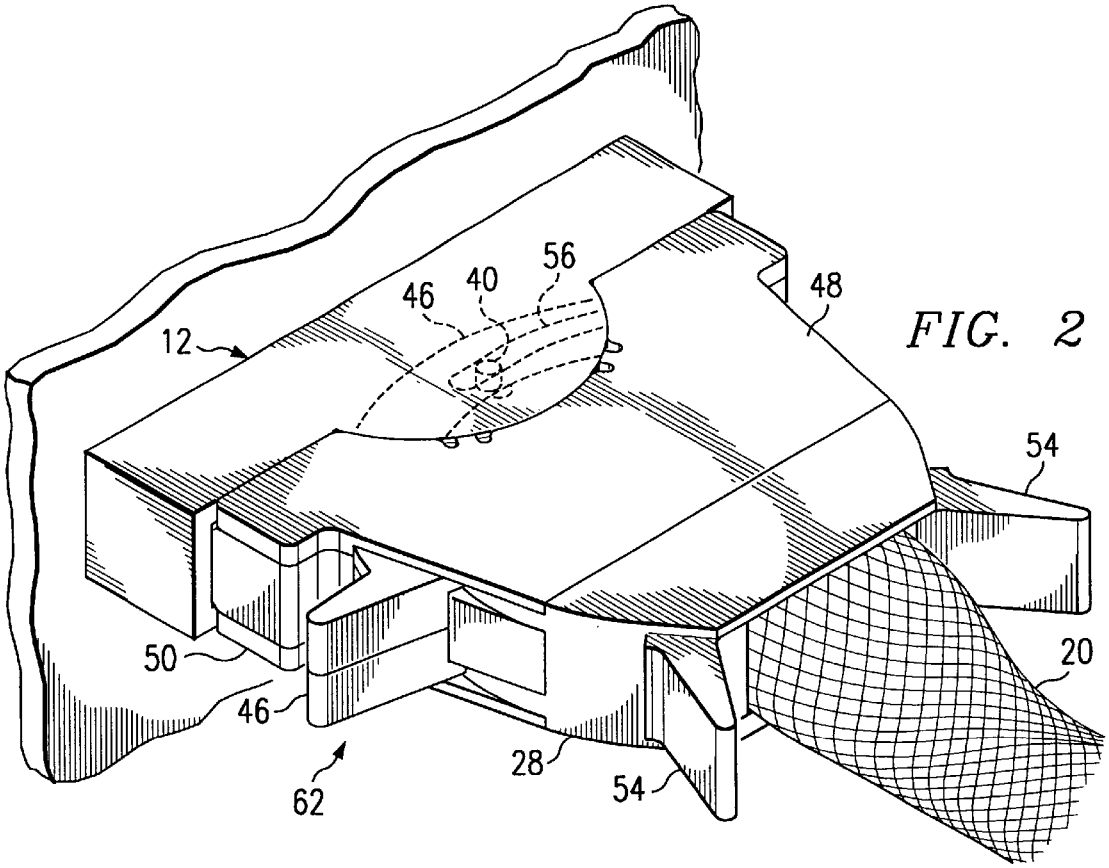
FIG. 2 is a diagram illustrating engagement of the electrical connector system illustrated in FIG. 1 in accordance with an embodiment of the present invention.

FIG. 1 is a diagram illustrating an electrical connector system 10 in accordance with an embodiment of the present invention, and FIG. 2 is a diagram illustrating engagement of the electrical connector system 10 illustrated in FIG. 1 in accordance with an embodiment of the present invention. System 10 comprises a cable dock 12 and a backshell assembly 14. Cable dock 12 and backshell assembly 14 each include an electrical connector 16 and 18, respectively, adapted for engagement with each other. For example, electrical connector 16 may include female receptacles adapted to receive corresponding male contacts of connector 18 (not explicitly shown) to form desired electrical connections between a cable or conduit 20 coupled to backshell assembly 14 and corresponding electronic connections coupled to cable dock 12 (not explicitly shown).

Figure 3:
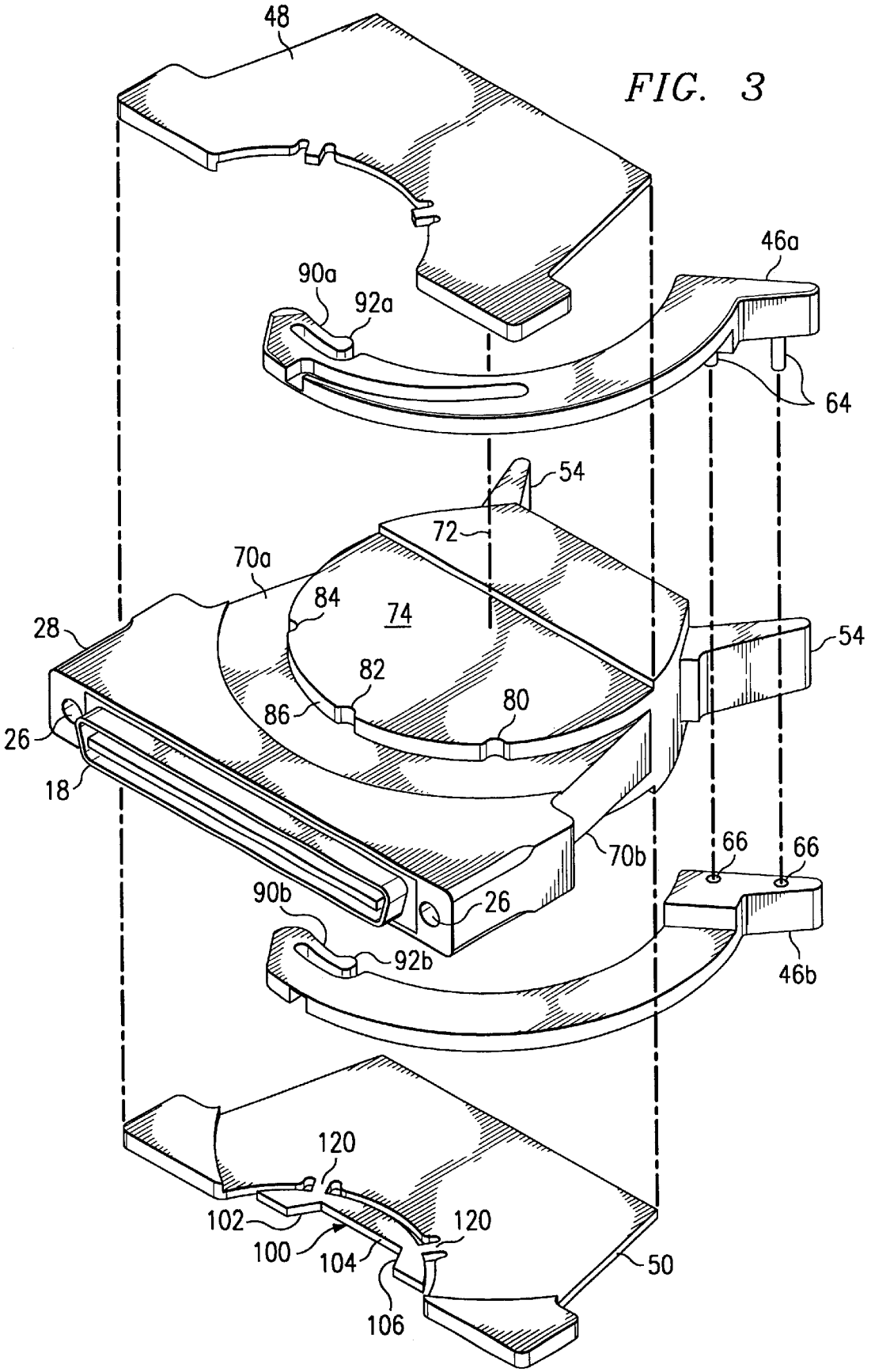
FIG. 3 is a diagram illustrating an exploded view of the electrical connector system illustrated in FIGS. 1 and 2 in accordance with an embodiment of the present invention.

Cable dock 12 includes a support frame 22 extending about electrical connector 16 and a plurality of guide pins 24 for aligning electrical connector 16 with electrical connector 18. For example, guide pins 24 may be formed and positioned to align with corresponding openings 26 of backshell assembly 14, as best illustrated in FIG. 3. Referring to FIGS. 1 and 2, frame 22 is constructed having a generally rectangular configuration corresponding to a generally rectangular configuration of a backshell housing 28 of backshell assembly 14; however, frame 22 and backshell housing 28 may be constructed having other suitable corresponding geometric configurations for engaging electrical connectors 16 and 18.

Frame 22 comprises laterally disposed support walls 30, a top support wall 32 and a bottom support wall 34. Frame 22 also comprises an arcuately formed polarity guide 36 extending outwardly from top support wall 32 towards backshell assembly 14 and a trapezoidally formed polarity guide 38 extending outwardly from bottom support wall 34 towards backshell assembly 14. As will be described in greater detail in conjunction with FIG. 3, polarity guides 36 and 38 substantially prevent misalignment of connector 16 with connector 18.

Cable dock 12 also includes a pair of oppositely disposed locking elements 40 extending inwardly toward each other. Locking elements 40 are medially disposed relative to a longitudinal direction of support walls 32 and 34 and are spaced apart from an outwardly facing surface 42 of connector 16. In the embodiment illustrated in FIGS. 1 and 2, locking elements 40 comprise latch pins 44; however, locking elements 40 may be constructed having other suitable geometric configurations for cooperating with a latch 46 coupled to backshell assembly 14. The engagement and cooperation of locking elements 40 and latch 46 will be described in greater detail below.

Backshell assembly 14 includes a top cover plate 48 and a bottom cover plate 50. Cover plates 48 and 50 are disposed on each side of latch 46 and prevent disengagement of latch 46 from backshell assembly 14. For example, in the embodiment illustrated in FIGS. 1 and 2, latch 46 is constructed having a substantially arcuate configuration extending laterally outward from a single side of backshell assembly 14. Cover plates 48 and 50 prevent disengagement of latch 46 from backshell assembly 14 while providing actuation of latch 46 relative to backshell assembly 14. However, it should be understood that latch 46 may be otherwise configured alleviating a requirement of cover plates 48 and 50. Cover plates 48 and 50 may be coupled to backshell housing 28 using fasteners (not explicitly shown) or other suitable methods or devices.

Latch 46 includes a laterally disposed handle 52 for actuation of latch 46. Backshell housing 28 also includes a pair of laterally disposed handles 54 disposed rearwardly of connector 18 to accommodate physical manipulation of backshell assembly 14. For example, handles 54 may be used to manipulate backshell assembly 14 into alignment with cable dock 12 and may be used to disengage backshell assembly 14 from cable dock 12. Generally, handles 54 may impede access to jackscrews that may be coupled to prior backshell assemblies. However, the present invention allows for the formation and positioning of handles 54 without impairing engagement mechanisms of the connector system.

In operation, backshell assembly 14 is aligned with cable dock 12 by aligning guide pins 24 with openings 26 in backshell assembly 14. Backshell assembly 14 is positioned relative to cable dock 12 such that locking elements 40 are received in guides 56 of latch 46. Guides 56 are formed on each side of latch 46 corresponding to the locations of locking elements 40 and are adapted to engage locking elements 40. After locking elements 40 are positioned within guides 56, latch 46 is actuated relative to backshell assembly 14 to linearly move backshell assembly 14 toward cable dock 12 in the direction indicated generally by arrow 58 to engage connector 18 with connector 16. For example, handle 52 of latch 46 may be actuated from a position indicated generally by arrow 60, as best illustrated in FIG. 1, to a position indicated generally by arrow 62, as best illustrated in FIG. 2. As latch 46 moves from position 60 to position 62, guides 56 cause linear movement of backshell assembly 14 toward cable dock 12 and corresponding engagement of connector 16 with connector 18.

Thus the present invention provides increased ease of use than prior electrical connector systems by reducing the force required to be applied by a user of system 10 to engage connectors 16 and 18. For example, prior jackscrew electrical connector systems generally require the user to engage the corresponding connectors prior to jackscrew engagement. The jackscrews are generally used to secure the connectors together after engagement of the connectors. Thus, an engagement force directed generally linearly between the connectors must be applied by the user to engage the corresponding connectors. In accordance with the present invention, the moment arm defined by guide 56 and handle 52 of latch 46 causes a reduction in the amount of force required to be applied by the user to engage connectors 16 and 18. Additionally, the interaction of guides 56 and locking elements 40 automatically align the engagement force linearly between connectors 16 and 18.

FIG. 3 is a diagram illustrating an exploded view of backshell assembly 14 in accordance with an embodiment of the present invention. As illustrated in FIG. 3, latch 46 comprises a pair of latch elements 46*a* and 46*b* disposed on opposite sides of backshell housing 28. In this embodiment, latch element 46*a* includes a pair of pins 64 for engaging corresponding openings 66 in latch element 46*b* to secure latch elements 46*a* and 46*b* together. However, other suitable methods or devices may be used for securing together latch element 46*a* and 46*b*.

Backshell housing 28 includes a pair of grooves 70*a* and 70*b* disposed on each side of backshell housing 28 and adapted for receiving a corresponding latch element 46*a* and 46*b*, respectively. In this embodiment, latch elements 46*a* and 46*b* are formed having a generally arcuate configuration corresponding with a generally arcuate configuration of grooves 70*a* and 70*b* such that actuation of latch 46 relative to backshell assembly 14 causes rotational movement of latch elements 46*a* and 46*b* within grooves 70*a* and 70*b*, respectively, generally about an axis 72. As illustrated in FIG. 3, axis 72 is substantially orthogonal to linear movement of backshell assembly 14 along the direction indicated by arrow 58 and substantially orthogonal to a surface 74 of backshell housing 28.

Backshell housing 26 also includes recesses or notches 80, 82 and 84 formed in a forwardly facing sidewall 86 of each groove 70*a* and 70*b*. Recesses 80, 82 and 84 cooperate with a corresponding cantilever portions 90*a* and 90*b* of latch elements 40*a* and 40*b*, respectively, to secure latch in desired positions relative to backshell assembly 14 and to provide feedback to a user of system 10 that latch 46 is fully engaged or disengaged. For example, cantilever portions 90*a* and 90*b* each include a rearwardly extending protrusion 92*a* and 92*b*, respectively, adapted for engagement with corresponding recesses 80, 82 and 84 as latch elements 46*a* and 46*b* slide within grooves 70*a* and 70*b*. In operation, protrusions 92*a* and 92*b* are positioned in engagement with recess 82 in preparation for receiving locking elements 40 of cable dock 12. The cooperation of protrusions 92*a* and 92*b* and recess 82 retain latch 46 in the desired position for receiving and engaging locking elements 40. The position for initially receiving and engaging locking elements 40 is illustrated as position 60 of latch 46, as best illustrated in FIG. 1.

Referring to FIG. 3, actuation of latch 46 from position 60 causes cantilever portions 90*a* and 90*b* to flex in a forward direction, thereby allowing disengagement of protrusions 92*a* and 92*b* from recess 82. As latch 46 moves from the position 60 to the position 62, protrusions 92*a* and 92*b* travel within grooves 70*a* and 70*b*, respectively, until protrusions 92*a* and 92*b* engage recess 84. The interaction of protrusions 92*a* and 92*b* with recess 84 retains latch 46 in a desired position to secure engagement of electrical connectors 16 and 18. Additionally, interaction of protrusions 92*a* and 92*b* with recesses 80, 82 and 84 provide feedback to a user of system 10 that latch 46 has reached predetermined positions for receiving locking elements 40 or securing engagement of electrical connectors 16 and 18.

In the embodiment illustrated in FIG. 3 and described above, three recesses 80, 82 and 84 are illustrated to provide for symmetrical assembly and construction of backshell assembly 14. However, only a pair of recesses 80 and 82 or 82 and 84 are generally required for engagement with protrusions 92*a* and 92*b* during actuation of latch 46. For example, as described above, protrusions 92*a* and 92*b* engage recesses 82 and 84 during actuation of latch 46 from the position 60 to position 62. However, backshell assembly 14 may be assembled having handle 52 of latch 46 disposed on an opposite side of backshell housing 28 from that illustrated in FIGS. 1–3, thereby providing engagement of protrusions 92*a* and 92*b* of latch 46 with recesses 80 and 82. Thus, the present invention also provides for a variety of design configurations.

System 10 also substantially prevents misalignment of connector 16 with connector 18. For example, as illustrated in FIG. 3, cover plate 50 includes a plurality extension 100 adapted for engagement with polarity guide 38, as best illustrated in FIG. 1, to substantially prevent misalignment of electrical connector 16 with electrical connector 18. For example, polarity extension 100 includes sidewalls 102, 104 and 106 formed having a generally trapezoidal configuration relative to each other for engagement with corresponding sidewalls 108, 110 and 112, respectively, of polarity guide 38. As best illustrated in FIG. 1, polarity guide 36 is formed having a generally arcuate configuration, thereby substantially preventing polarity a generally trapezoidally formed polarity extension 100 from being positioned adjacent polarity guide 36. Thus, polarity guides 36 and 38 and polarity extension 100 substantially prevent misalignment of electrical connector 18 with electrical connector 16. It should also be understood that polarity guides 36 and 38 and polarity extension 100 may be constructed having other suitable geometric configurations to prevent misalignment of connectors 16 and 18.

Additionally, both cover plates 48 and 50 may be constructed having polarity extension 100, thereby providing for ease of manufacture and assembly. For example, as best illustrated in FIG. 3, polarity extension 100 is coupled to cover plate 50 by a plurality of stems 120. Stems 120 may be constructed having a cross-sectional area such that polarity extension 100 may be removed from cover plate 50 by bending polarity extension 100 relative to cover plate 50 or by cutting stems 120 to remove polarity extension 100, thereby resulting in the formation of cover plate 48. Thus, cover plates 48 and 50 may be constructed substantially identical to each other and polarity extension 100 may be removed from cover plate 48 at a predetermined step during the construction of backshell assembly 14 to accommodate engagement of polarity extension 100 of cover plate 50 with polarity guide 38.

In the embodiment illustrated in FIGS. 1–3, a pair of oppositely disposed locking elements 40 are used to engage a corresponding pair of guides 56 disposed on opposite sides of backshell assembly 14 to provide symmetrical linear forces to engage connectors 16 and 18. However, it should be understood that a single locking element 40 and guide 56 may also be used to engage connectors 16 and 18. Additionally, in the embodiment illustrated in FIGS. 1–3, latch 46 comprises a single handle 52 extending laterally to a single side of backshell assembly 14. However, it should be understood that latch 46 may also be constructed having a pair of handles 52, each of the pair of handles 52 extending laterally to an opposite side of backshell assembly 14 in a substantially diametrically opposed relationship to each other to accommodate actuation of latch 46 from both sides of backshell assembly 14. For example, opposing forces to actuate latch 46 may be applied to handles 52 in substantially opposite directions to cause rotation of latch 46 about axis 72. Thus, the present invention provides increased design flexibility than prior electrical connector systems.

Figure 4:
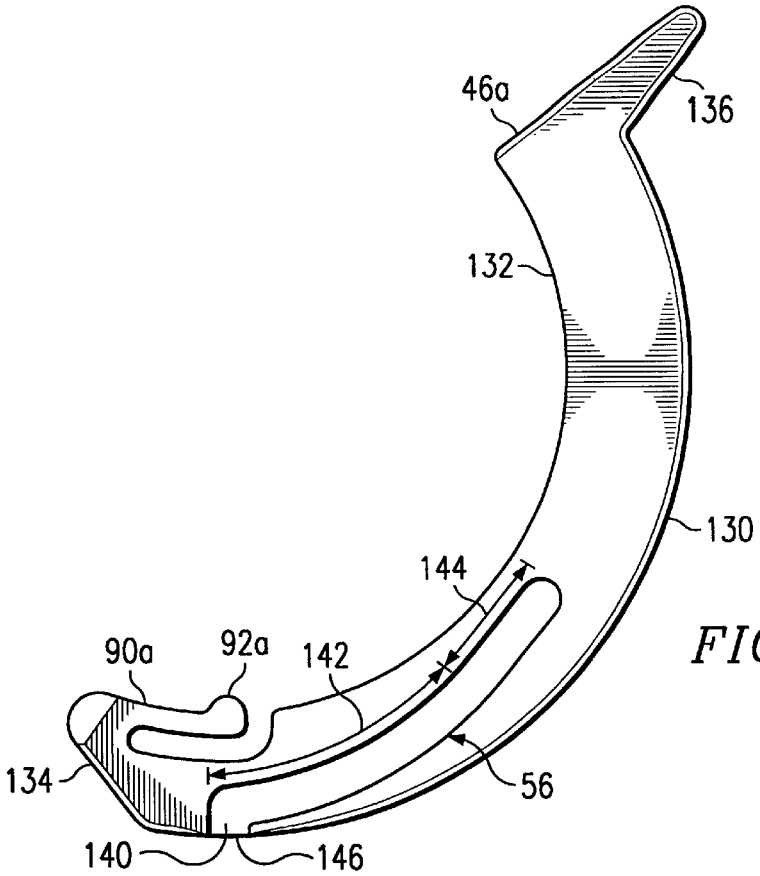
FIG. 4 is a diagram illustrating a latch element of the electrical connector system illustrated in FIGS. 1–3 in accordance with an embodiment of the present invention.

FIG. 4 is a diagram illustrating a single latch element 46*a* in accordance with an embodiment of the present invention. It should be understood that, in accordance with the embodiment illustrated in FIGS. 1–3, various features of latch element 46*a* are also constructed on latch element 46*b*. Latch element 46*a* includes a forwardly disposed edge 130 directed toward cable dock 12 and a rearwardly disposed edge 132 directed away from cable dock 12. Guide 56 is configured having a width adapted to receive locking elements 40 and generally extends away from an end 134 of latch element 46*a* toward a handle portion 136 of latch element 46*a*. Guide 56 includes a receiving region 140, a guide region 142, and a dwell region 144. Receiving region 140 comprises an opening 146 formed in edge 130 for receiving a locking element 40. For example, receiving region 140 extends rearwardly away from edge 130 to allow locking element 40 to enter guide 56 and travel within contiguous portions of guide 56 upon actuation of latch 46.

Guide 56 is formed gradually extending away from edge 110 such that actuation of latch element 46*a* causes locking element 40 to be drawn away from edge 130, thereby providing linear movement of backshell assembly 14 relative to cable dock 12. For example, guide region 142 is contiguous with receiving region 140 and extends away from edge 110 along a generally curved or acuate slope to provide linear movement of backshell assembly 14 relative to cable dock 12.

Contiguous with guide region 142 is dwell region 144. Dwell region 144 is formed substantially concentric with the axis 72 of rotation of latch 46 such that linear movement of backshell assembly 14 relative to cable dock 12 substantially ceases as locking element 40 travels within dwell region 144. Thus, dwell region 144 substantially prevents disengagement of connector 18 from connector 16. For example, dwell region 144 substantially prevents linear movement of backshell assembly 14 relative to cable dock 12 which may otherwise result from a force applied to backshell assembly 14 in a direction substantially opposite that of direction 58. Thus, dwell region 144 substantially prevents inadvertent actuation of latch 46 relative to backshell assembly which may result from a force applied to backshell assembly 14 in a direction substantially opposite that of direction 58.

The above described process may also be reversed to disengage connector 18 from connector 16. For example, latch 46 may be actuated relative to backshell assembly 14 from position 62 to position 60. As a disengagement force is applied to latch 46, protrusions 92*a* and 92*b* disengage recess 84, thereby allowing slidable movement of latch 46 within grooves 70*a* and 70*b*. As latch 46 is actuated, latch elements 46*a* and 46*b* rotate relative to backshell assembly 14 about axis 72, thereby causing corresponding movement of guide 56 relative to locking elements 40. Movement of guide 56 relative to backshell assembly 14 causes linear movement of backshell assembly 14 relative to cable dock 12 in a direction opposite that indicated by arrow 58 as locking elements 40 travel within guide region 142 of guide 56. As latch 46 reaches position 60, protrusions 92*a* and 92*b* engage recesses 82, thereby indicating to a user of system 10 that locking elements 40 may be disengaged from latch 46 and corresponding disengagement of backshell assembly 14 from cable dock 12.

Additionally, handles 54 of backshell housing 54 may be used to accommodate actuation of latch 46. For example, a user of system 10 may grip handle 52 of latch 46 and one of handles 54 to apply a squeezing force to handle 52 and handle 54 to cause actuation of latch 46. Thus, the present invention provides for increased ease of disengagement of backshell assembly 14 from cable dock 12.

Although the present invention and its advantages have been described in detail, it should be understood that various changes, substitutions, and alterations, can be made therein without departing from the spirit and scope of the present invention as defined by the appended claims.

What is claimed is:

1. An electrical connector system, comprising:

a cable dock having a first connector;

a backshell assembly having a second connector, the second connector adapted for engagement with the first connector;

a locking element coupled to the cable dock; and a latch coupled to the backshell assembly, the latch operable to engage the locking element and, in response to movement of the latch relative to the backshell assembly, engage the first connector with the second connector, wherein the latch comprises a cantilever portion operable to engage a corresponding recess disposed on the backshell assembly to secure the latch in a substantially fixed position relative to the backshell assembly.

2. The system of claim 1, wherein the latch comprises an arcuately formed latch element, and wherein the movement of the latch causes corresponding rotation of the latch element about an axis, the axis substantially orthogonal to linear movement of the first connector relative to the second connector.

3. The system of claim 1, wherein the latch comprises a guide adapted to receive the locking element.

4. The system of claim 3, wherein the guide comprises:

a guide region operable to cause linear movement of the second connector relative to the first connector during movement of the latch; and a dwell region contiguous with the guide region, the dwell region operable to secure the first connector in a substantially fixed linear position relative to the second connector during movement of the latch.

5. The system of claim 1, further comprising a polarity guide coupled to the cable dock and adapted for engagement with a corresponding polarity extension disposed on the backshell assembly to align the first connector with the second connector.

6. The system of claim 1, wherein the cable dock comprises a plurality of guide pins operable to engage a plurality of corresponding openings disposed in the backshell assembly to align the first connector with the second connector.

7. The system of claim 6, wherein the backshell assembly comprises a plurality of handles disposed rearwardly from the second connector, the handles operable to support an opposing force in response to a force applied to the latch.

8. A method for connecting and disconnecting an electrical connector assembly, comprising:

aligning a first connector coupled to a cable dock with a second connector coupled to a backshell assembly, the first connector adapted for engagement with the second connector;

receiving a locking element coupled to the cable dock in a latch, the latch coupled to the backshell assembly;

engaging the first connector with the second connector by actuating the latch relative to the backshell assembly; and disengaging the first connector from the second connector by actuating the latch in a direction opposite a direction to engage the first and second connectors, wherein disengaging further comprises disengaging a cantilever portion of the latch from a recess disposed on the backshell assembly.

9. The method of claim 8, wherein receiving the locking element comprises receiving the locking element in a guide formed on the latch.

10. The method of claim 9, wherein engaging the first connector with the second connector comprises:

linearly moving the second connector relative to the first connector by passing the locking element through a guide region of the groove; and securing the first connector in a substantially fixed linear position relative to the second connector by passing the locking element through a dwell region of the groove, the dwell region contiguous with the guide region.

11. The method of claim 8, wherein aligning the first connector comprises aligning a polarity guide coupled to the cable dock with a corresponding polarity extension coupled to the backshell assembly.

12. The method of claim 8, wherein aligning the first connector further comprises aligning a plurality of guide pins coupled to the cable dock with a plurality of corresponding openings disposed in the backshell assembly.

13. The method of claim 8, wherein actuating the latch comprises rotating an arcuately formed latch element about an axis, the axis substantially orthogonal to linear movement of the first connector relative to the second connector.

14. The method of claim 8, further comprising disengaging the first connector from the second connector by actuating the latch in a direction opposite a direction to engage the first and second connectors.

15. The method of claim 14, wherein disengaging comprises:

passing the locking element through a guide of the latch; and disengaging the locking element from the guide.

16. The method of claim 15, wherein passing the locking element through the guide comprises:

passing the locking element through a dwell region of the guide, the dwell region maintaining the second connector in a substantially fixed linear position relative to the first connector; and passing the locking element through a guide region of the guide to linearly move the second connector apart from the first connector, the guide region contiguous with the dwell region.

17. An electrical connector system comprising:

a cable dock having a first connector;

a backshell assembly having a second connector adapted for engagement with the first connector;

a locking element disposed on the cable dock; and a latch coupled to the backshell assembly, the latch having a first end and a second end, the second end having a guide adapted to receive the locking element, and wherein movement of the first end of the latch relative to the backshell assembly causes corresponding movement of the guide relative to the locking element, the movement of the guide relative to the locking element causing linear movement of the first connector into engagement with the second connector, wherein the latch comprises a cantilever portion disposed on the second end, the cantilever portion operable to engage a corresponding recess formed in the backshell assembly to indicate engagement of the first connector with the second connector.

18. The system of claim 17, wherein the guide comprises:

a guide region operable to cause linear movement of the second connector relative to the first connector during the movement of the first end of the latch; and a dwell region contiguous with the guide region, the dwell region operable to secure the first connector in a substantially fixed linear position relative to the second connector during movement of the first end of the latch.

19. The system of claim 17, wherein the latch comprises a forward edge and a rearward edge, the forward edge disposed toward the cable dock, and wherein the guide extends from the forward edge and curves rearwardly toward the rearward edge.

20. The system of claim 17, wherein the latch comprises an arcuately formed latch element, and wherein movement of the first end causes rotational movement of the latch element about an axis, the axis substantially orthogonal to the linear movement of the first and second connector.

21. The system of claim 17, wherein the cable dock comprises a plurality of guide pins operable to engage a plurality of corresponding openings disposed in the backshell assembly to align the first connector with the second connector.

22. The system of claim 17, further comprising a polarity guide coupled to the cable dock and adapted for engagement with a corresponding polarity extension disposed on the backshell assembly to align the first connector with the second connector.

23. The system of claim 17, wherein the latch comprises a handle, the handle extending laterally to a single side of the backshell assembly.

24. The system of claim 17, wherein the locking element comprises a latch pin, and wherein the guide is adapted to receive the latch pin.

25. A method for connecting and disconnecting an electrical connector assembly, comprising:

aligning a first connector coupled to a cable dock with a second connector coupled to a backshell assembly, the first connector adapted for engagement with the second connector;

receiving a locking element coupled to the cable dock in a guide formed on a latch, the latch coupled to the backshell assembly; and engaging the first connector with the second connector by actuating the latch relative to the backshell assembly, wherein engaging further comprises:

linearly moving the second connector relative to the first connector by passing the locking element through a guide region of the groove; and securing the first connector in a substantially fixed linear position relative to the second connector by passing the locking element through a dwell region of the groove, the dwell region contiguous with the guide region, wherein securing further comprises securing the first connector in the substantially fixed linear position by disposing a cantilever portion of the latch in a corresponding recess formed in the backshell assembly.

26. The method of claim 25, wherein aligning the first connector comprises aligning a polarity guide coupled to the cable dock with a corresponding polarity extension coupled to the backshell assembly.

27. The method of claim 25, wherein aligning the first connector further comprises aligning a plurality of guide pins coupled to the cable dock with a plurality of corresponding openings disposed in the backshell assembly.

28. The method of claim 25, wherein actuating the latch comprises rotating an arcuately formed latch element about an axis, the axis substantially orthogonal to linear movement of the first connector relative to the second connector.

* * * * *

UNITED STATES PATENT AND TRADEMARK OFFICE

CERTIFICATE OF CORRECTION

PATENT NO. : 6,293,813 B1
DATED : September 25, 2001
INVENTOR(S) : Andrew L. Johnston et al.

It is certified that error appears in the above-identified patent and that said Letters Patent is hereby corrected as shown below:

Title page,
Item [73], Assignee, after "Silicon Graphics", insert -- Inc. --.

Signed and Sealed this

Nineteenth Day of March, 2002

*Attest:*

*Attesting Officer*

JAMES E. ROGAN
*Director of the United States Patent and Trademark Office*